US011160363B2

(12) United States Patent
Deane et al.

(10) Patent No.: US 11,160,363 B2
(45) Date of Patent: Nov. 2, 2021

(54) SYSTEM AND METHOD FOR DETERMINING AND NOTIFYING A USER WHEN TO REPLACE A DENTAL CLEANING HEAD

(71) Applicant: KONINKLIJKE PHILIPS N.V., Eindhoven (NL)

(72) Inventors: Steven Charles Deane, Cambridge (GB); Vincent Jeanne, Migne Auxances (FR); Gregory Russ Goddard, Kenmore, WA (US); Toon Hardeman, S'Hertogenbosch (NL); Martin John Edwards, Solihull (GB)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 314 days.

(21) Appl. No.: 16/061,420

(22) PCT Filed: Dec. 14, 2016

(86) PCT No.: PCT/EP2016/081080

§ 371 (c)(1),
(2) Date: Jun. 12, 2018

(87) PCT Pub. No.: WO2017/102890

PCT Pub. Date: Jun. 22, 2017

(65) Prior Publication Data

US 2020/0260859 A1 Aug. 20, 2020

Related U.S. Application Data

(60) Provisional application No. 62/267,341, filed on Dec. 15, 2015.

(51) Int. Cl.
*A46B 15/00* (2006.01)

(52) U.S. Cl.
CPC ..... *A46B 15/001* (2013.01); *A46B 15/0038* (2013.01); *A46B 2200/1066* (2013.01)

(58) Field of Classification Search
None
See application file for complete search history.

(56) References Cited

U.S. PATENT DOCUMENTS 3,783,364 A * 1/1974 Gallanis ..... G09B 19/0084 320/115
5,313,909 A * 5/1994 Tseng ..... D01D 5/34 116/208

(Continued)

FOREIGN PATENT DOCUMENTS

CA 2211382 A1 1/1998
CN 104273932 A 1/2015

(Continued)

*Primary Examiner* — Fekadeselassie Girma

(57) ABSTRACT

A system and method of determining and notifying a user when to replace a worn dental cleaning head (104), comprises receiving, from a sensor (106), at least one measured value; calculating, using the measured value, a burn metric of the dental cleaning head; modeling, using the burn metric, an estimated lifetime of the dental cleaning head; determining, from the lifetime model, whether the dental cleaning head is in need of replacement; and notifying the user upon determining that the dental cleaning head is in need of replacement.

23 Claims, 4 Drawing Sheets

(56) References Cited

U.S. PATENT DOCUMENTS 6,081,957 A * 7/2000 Webb ..... A46B 15/0002 15/105
6,381,794 B1 * 5/2002 Porper ..... A46B 5/0012 15/167.2
6,536,068 B1 * 3/2003 Yang ..... A46B 15/0002 15/105
6,735,802 B1 * 5/2004 Lundell ..... A61C 17/22 15/105
8,771,149 B2 7/2014 Rahman et al.
9,027,192 B1 * 5/2015 Cole ..... A46B 15/0044 15/105
10,172,443 B2 * 1/2019 Wang ..... A46B 15/0008
2006/0166157 A1 * 7/2006 Rahman ..... A61B 5/4833 433/6
2007/0202467 A1 * 8/2007 Hohlbein ..... A46B 15/0081 433/217.1
2008/0131842 A1 * 6/2008 Edwards ..... A46B 5/02 433/215
2008/0256445 A1 * 10/2008 Oleh ..... G16H 40/67 715/700
2009/0092955 A1 * 4/2009 Hwang ..... A61C 17/221 434/263
2010/0058548 A1 * 3/2010 Grez ..... A46B 9/04 15/22.1
2010/0269281 A1 * 10/2010 Gottenbos ..... A61C 17/20 15/167.1
2010/0323337 A1 * 12/2010 Ikkink ..... A46B 15/0002 434/263
2011/0119848 A1 * 5/2011 Kloster ..... F16F 1/025 15/167.1
2012/0167393 A1 * 7/2012 Lelieveld ..... B26B 21/446 30/41
2012/0198635 A1 * 8/2012 Hilscher ..... A61B 18/00 15/22.1
2012/0246858 A1 * 10/2012 De Vries ..... A46B 15/0044 15/167.1
2012/0251971 A1 * 10/2012 Fish ..... A61C 19/066 433/27
2013/0166220 A1 * 6/2013 Bates ..... A46B 15/0006 702/19
2013/0177863 A1 * 7/2013 Shreve ..... A46B 15/0008 433/27
2013/0333133 A1 * 12/2013 Miller ..... A61C 17/00 15/167.1
2014/0266713 A1 * 9/2014 Sehgal ..... G16H 40/40 340/540
2014/0345070 A1 * 11/2014 Miller ..... A46B 3/00 15/21.1
2015/0202030 A1 * 7/2015 Miller ..... A46B 15/0038 15/22.1
2015/0230594 A1 * 8/2015 De Vries ..... A46B 15/0002 15/22.1
2015/0230898 A1 * 8/2015 Miller ..... A61C 17/221 15/22.1
2015/0282912 A1 * 10/2015 Prins ..... A61B 5/4547 433/80
2015/0297327 A1 * 10/2015 Miller ..... A61C 17/221 15/22.1
2015/0320353 A1 * 11/2015 Spruit ..... A46B 15/0036 433/27
2015/0335144 A1 * 11/2015 Patel ..... A46B 15/0044 15/167.1
2016/0015492 A1 * 1/2016 Skaanland ..... A61C 17/221 15/22.2
2016/0338810 A1 * 11/2016 Schmalhurst ..... A46B 11/002
2017/0056146 A1 * 3/2017 Boughorbel ..... A61C 17/221
2017/0079421 A1 * 3/2017 Tamminga ..... A61C 1/0015
2017/0303791 A1 * 10/2017 Vermeulen ..... A46B 15/0044
2017/0347787 A1 * 12/2017 Bos ..... A61K 8/736
2018/0103747 A1 * 4/2018 Lavezzo ..... A46B 5/007
2018/0125218 A1 * 5/2018 Dengler ..... A46D 3/045
2018/0250108 A1 * 9/2018 Tamminga ..... A46B 15/0006
2018/0368567 A1 * 12/2018 Buil ..... A46B 15/0036
2019/0038014 A1 * 2/2019 Greer, Jr. ..... A46B 15/0044
2019/0103045 A1 * 4/2019 Vugts ..... G09F 13/22
2020/0085178 A1 * 3/2020 Van Den Ende .... A61C 17/222

FOREIGN PATENT DOCUMENTS

CN 105822706 A 8/2016
WO 2006119376 A2 11/2006
WO 2017001399 A1 1/2017
WO 2017002004 A1 1/2017
WO 2017002012 A1 1/2017

* cited by examiner

SYSTEM AND METHOD FOR DETERMINING AND NOTIFYING A USER WHEN TO REPLACE A DENTAL CLEANING HEAD

CROSS-REFERENCE TO PRIOR APPLICATIONS

This application is the U.S. National Phase application under 35 U.S.C. § 371 of International Application No. PCT/EP2016/081080, filed on Dec. 14, 2016, which claims the benefit of U.S. Provisional Patent Application No. 62/267,341, filed on Dec. 15, 2015. These applications are hereby incorporated by reference herein.

FIELD OF THE INVENTION

The present disclosure is directed generally to systems and methods for predicting the lifetime of a dental cleaning head and providing feedback to a user about when to replace a dental cleaning head.

BACKGROUND

In general, dental cleaning devices become less effective as they begin to wear through normal use. Using the example of a toothbrush, the bristles of a toothbrush must be flexible and able to splay to attain proper brushing coverage. However, over the lifetime of the toothbrush, bristles become permanently deformed by repeated splaying, and eventually leading to loss of the bristle shape of the brush head, and lower effectiveness of plaque removal. While a brush head may often last three months with minimal reduction in performance, heavy or light user-applied load can accelerate or decelerate the degradation.

Some existing toothbrushes employ color fading bristles to act as replacement indicators, but these have limited effectiveness. The color change of the bristles is gradual, as it is a gradual process of fading of dye out of the fibers, and so users may not notice the change. In addition, the brush heads fade equally across all users, though users who use excessive force will splay the bristles much more quickly, and will need replacement much sooner to maintain effectiveness. Further, the color fading does not only depend on time but also other external influences, such as temperature and the length of time the toothbrush stays wet after use.

Due to the variation in accuracy of the dye fading, coupled with a lack of active engagement with or understanding of the indication method, user understanding of current indicator methods is often low. Indeed, it is generally understood that toothbrushes, and other dental cleaning devices are not replaced as frequently as is usually recommended by dentists. This includes the removable brush head portion of power toothbrushes, as well as tongue brush heads or nozzles for interproximal cleaning devices such as the Philips Sonicare® AirFloss® or an irrigator. Such dental cleaning heads can wear out to the point of significant reduction in effectiveness, but the user may not notice any performance deterioration. Reduced effectiveness, of course, is undesirable relative to maintaining dental health.

Accordingly, there is a need for more precisely indicating to a user when a dental cleaning head should be replaced so as to maintain a high level of performance and effectiveness.

SUMMARY OF THE INVENTION

The present disclosure is directed to inventive methods and systems for indicating to a user when a dental cleaning head, such as a brush head, should be replaced. Various embodiments and implementations herein are directed to a system that includes a dental cleaning device having a sensor for measuring a value that corresponds to a burn metric of a dental cleaning head. A computing device, including a processor and a non-transitory storage medium for storing program code, is programmed to receive the measured value and predict a lifetime of the dental cleaning head. The lifetime model may take into account the type of dental cleaning head used, such as the stiffness of the bristles and tufting pattern of a toothbrush head. The system may also include a dedicated application, such as a mobile application, or other means of notification, for notifying a user when it is time to replace the dental cleaning head.

Generally, in one aspect, a method of determining and notifying a user when to replace a worn dental cleaning head, comprises: receiving, from a sensor, at least one measured value; calculating, using the measured value, a burn metric of the dental cleaning head; modeling, using the burn metric, an estimated lifetime of the dental cleaning head; determining, from the lifetime model, whether the dental cleaning head is in need of replacement; and notifying the user upon determining that the dental cleaning head is in need of replacement.

According to an embodiment, the burn metric is a burn rate of the dental cleaning head.

According to an embodiment, the burn metric is a total burn of the dental cleaning head.

According to an embodiment, the step of estimating the burn rate comprises: inputting the at least one measured value into a predetermined model; inputting a cleaning time into the predetermined model; receiving from the predetermined model the estimated burn rate.

According to an embodiment, the predetermined model is selected from a plurality of predetermined models, according to a value of the dental cleaning head.

According to an embodiment, the step of modeling an estimated life of the dental cleaning head further comprises the steps of: inputting the burn metric and a previously measured burn metric into a predetermined nonlinear model; receiving from the predetermined nonlinear model the estimated life of the dental cleaning head.

According to an embodiment, the measured value is one of: a force, a user-applied load, or a characteristic of a drive train of a dental cleaning device.

According to an embodiment, the user is notified by a mobile application.

According to an embodiment, the lifetime model is stored on a remote server.

In another aspect, a system for notifying a user when to replace a worn dental cleaning head comprises: an application comprising program code stored on a non-transitory storage medium and programmed to: receive, from a dental cleaning device, data representing at least one measured value; estimate, from the received data, a burn metric of the dental cleaning head; model, using the estimated burn metric, an estimated life of the dental cleaning head; determine, from the lifetime model, whether the dental cleaning head is in need of replacement; and notify the user upon determining that the dental cleaning head is in need of replacement.

According to an embodiment, the system further comprise: a dental cleaning device, having at least one sensor configured to measure at least one measured value, wherein the dental cleaning device is configured to transmit, to the application, the at least one measured value.

According to an embodiment, the application is located within the dental cleaning device.

According to an embodiment, the application is distributed over at least a mobile device and a remote server.

According to an embodiment, the application is configured to notify the user via a push notification on a mobile device.

According to an embodiment, the measured value is one of: a force, a user-applied load, or a characteristic of a drive train of a dental cleaning device.

In various implementations herein, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers. In addition, the "program" or "computer code" is to be understood as being stored on a non-transitory, computer readable medium.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects of the invention will be apparent from and elucidated with reference to the embodiment(s) described hereinafter.

DETAILED DESCRIPTION OF EMBODIMENTS

The present disclosure describes various embodiments of a system and method for predicting the lifetime of a dental cleaning head. More generally, Applicant has recognized and appreciated that it would be beneficial to provide an active system for notifying a user when a dental cleaning head should be replaced. For example, the method and system for predicting the lifetime of a dental cleaning head may utilize a toothbrush, or other dental cleaning device, having a sensor for measuring a value that corresponds to a burn metric of a dental cleaning head, and a computing device, including a processor and a non-transitory storage medium for storing program code, programmed to receive the measured value and predict a lifetime of the dental cleaning head. The lifetime model may take into account the type of dental cleaning head used or a quality of the dental cleaning head, such as the stiffness of the bristles. The system may also include a dedicated application, or other means of notification, for notifying a user when it is time to replace the dental cleaning head.

Although the methods and systems described below are applied to any dental cleaning device (manual or power), including tongue brushes, and interproximal cleaning devices such as the Philips Sonicare® AirFloss® the methods and systems could similarly be utilized for any system having a measurable quality that may correlate to a predictable wear. One example of a power brush device that the methods and systems can be used with is the Sonicare® device available from Koninklijke Philips Electronics N.V.

Figure 1:
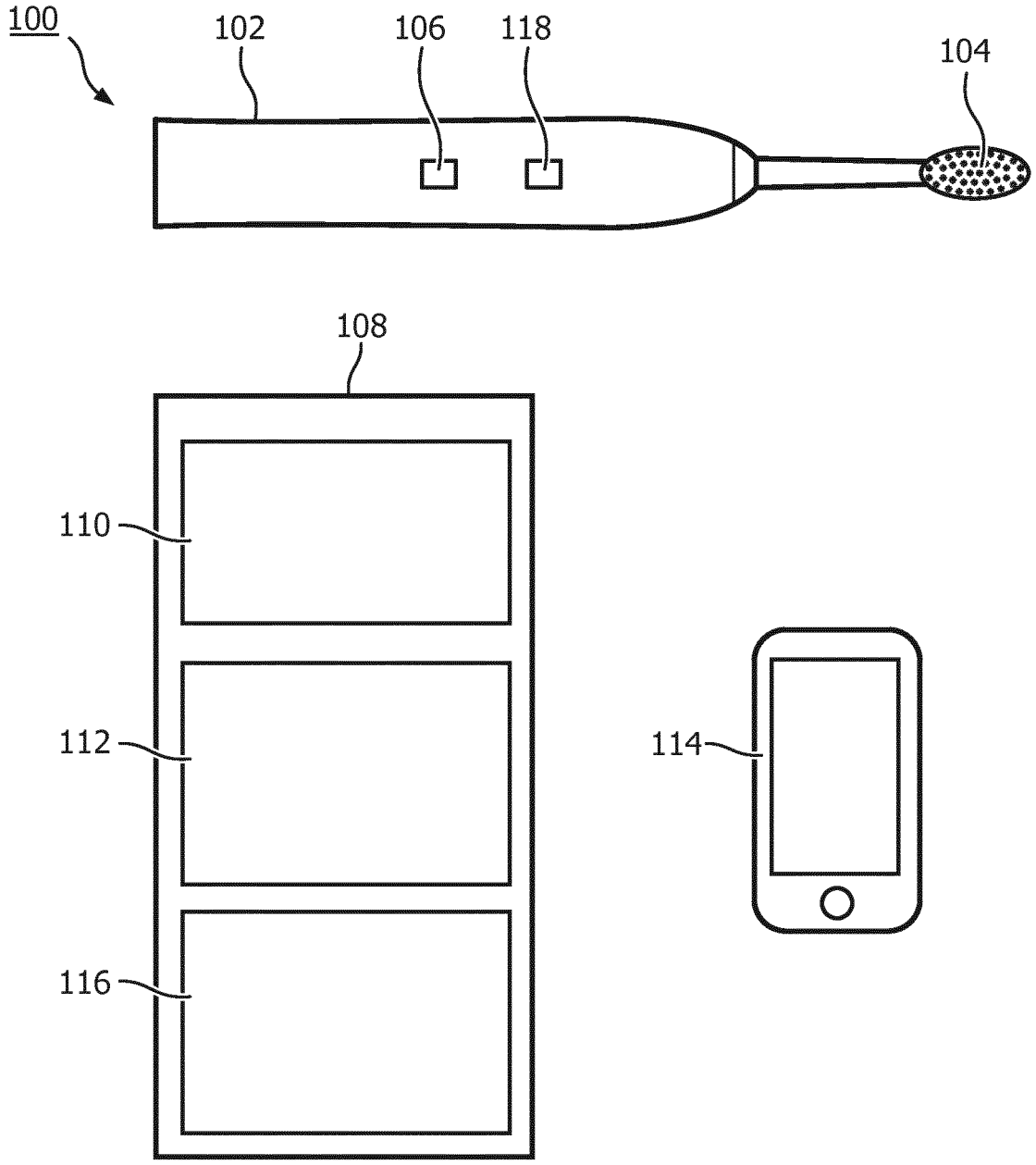
FIG. 1 is a schematic representation of a system for measuring the lifetime of a dental cleaning head, according to an embodiment.
Figure 2:
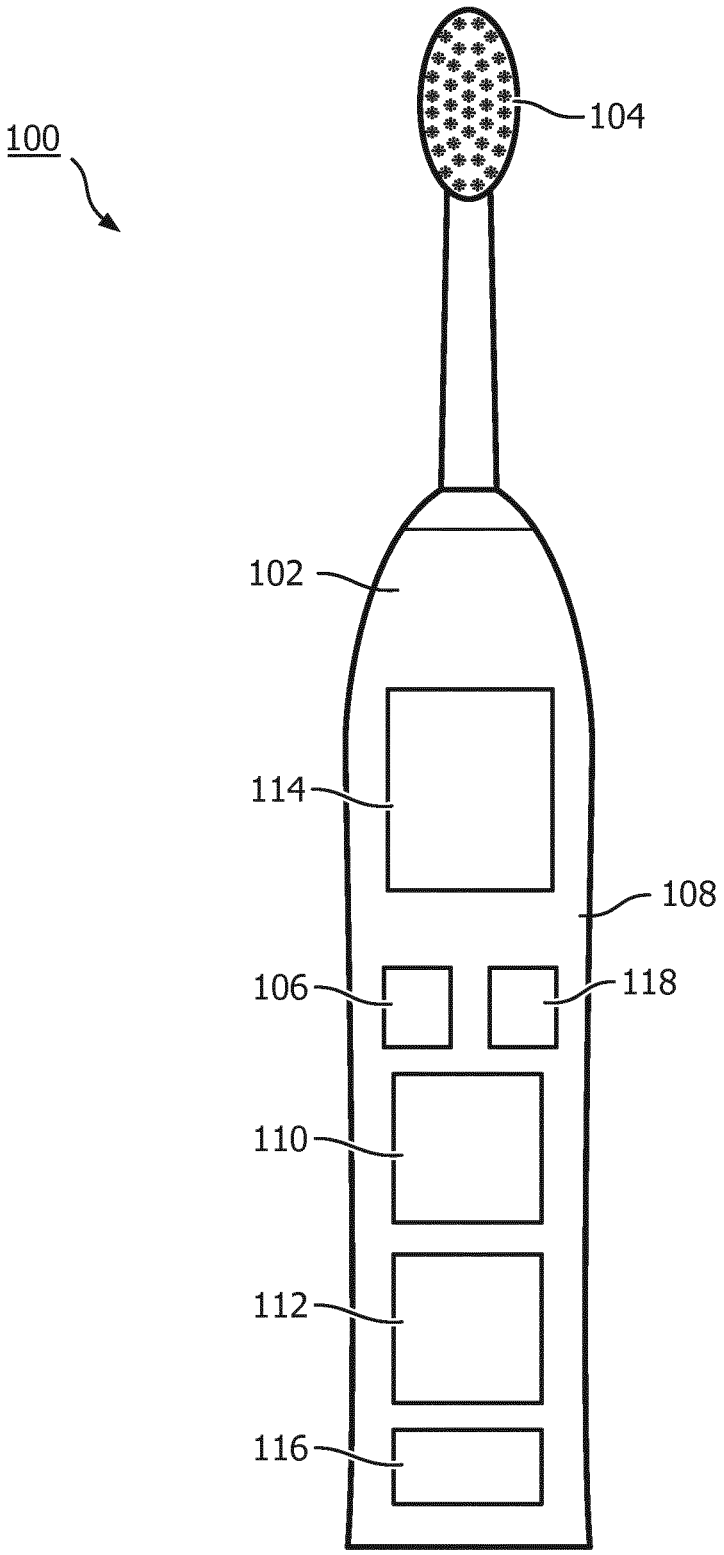
FIG. 2 is a schematic representation of a system for measuring the lifetime of a dental cleaning head, according to an embodiment.

Referring to FIG. 1, according to an embodiment, is a representation of a system 100 for calculating the lifetime of a dental cleaning device. System 100 may include a dental cleaning device 102, having a dental cleaning head 104, and which may have one or more sensors 106. Dental cleaning device 102 may be a power toothbrush, a tongue brush, a Philips Sonicare® AirFloss® or any other similar dental cleaning device which begins to measurably wear through continued use. In some embodiments, dental cleaning device 102 may be in communication with a local or back end system 108 adapted to receive a measurement from the sensor 106. Local or back end system 108 may comprise a processor 110 and a non-transitory storage medium 112, and be adapted to execute program code stored on the non-transitory storage medium 112 to determine, among other things, a lifetime model of the dental cleaning device 102 from a measurement received from sensor 106. Local or back end system 108 may be located on the dental cleaning device 102 itself or some other local device such as a mobile device, or a computer, or may be located on a back end system such as a remote server. Alternatively, local or back end system 108 may be distributed amongst some combination of those devices. System 100 may further include a display 114 in communication with local or back end system 108 to display the lifetime model of the dental cleaning head 104. Display 114, for example, may be a screen of a mobile device (as depicted in FIG. 1) programmed with a mobile application (mobile application may be a part of local or back end system 108, or may be a cooperative, stand-alone application) and programmed to display the lifetime of the dental cleaning head 104, or to display push notifications to notify a user when it is time (or almost time) to change dental cleaning head 104. Alternatively, display 114 may be on dental cleaning device 102 itself (as depicted in FIG. 2), a computer, or on some other dedicated device. System 100 may also include a memory 116 for storing at least one lifetime model of the dental cleaning head (note that memory 116 and the non-transitory storage medium 112 may be the same). In addition, dental cleaning device 102 may comprise a clock 118 which may be used to measure cleaning time or to measure a certain value such as the length of time that a force exceeds a particular pre-set value. As shown in FIGS. 1-2, dental cleaning device 102 may be an electric toothbrush with a detachable or integrated dental cleaning head 104.

For example, dental cleaning device 102 may be a disposable toothbrush with an integrated brush head, or may be an electric tooth brush with a replaceable brush head. For an integrated toothbrush embodiment, dental cleaning device 102 may be adapted to receive a sensor 106, memory 116, local or backend system 108, etc. Because different dental cleaning heads may have different qualities, such as bristle stiffness, and thus may burn differently, each dental cleaning head may have an identifier that may be automatically recognized by local or back end system 108. Alternately, the type of dental cleaning head may be manual input by a user. In an embodiment, dental cleaning head 104 may be recognized by a unique identifier, so that if two users share a handle, separate lifetime models may be tracked for each and reset automatically when a dental cleaning head is replaced. Alternately, a user may manually input when a new dental cleaning head has been purchased.

An alternative arrangement of system 100 is shown in FIG. 2, in which dental cleaning device 102 may comprise a local or back end system 108 internally. Alternately, where local or back end system 108 is implemented on a remote device, dental cleaning device 102 may have some communication channel, such as over Bluetooth or Wi-Fi, to communicate data measured by sensor 106 in real-time or as a summary. Dental cleaning device 102 may further communicate with a docking station, such as a charging station, which may then upload data from sensor 106 over Wi-Fi or through another means of communication.

Sensor 106 may be, in alternate embodiments, a force sensor, an accelerometer, a Hall Effect sensor, a microphone, or any other sensor that measures an effect on a drive train of dental cleaning device 102, force or user applied loading. Sensor 106 may be used to measure a value that may be translated to a burn metric; the burn metric may be at least one of two things: (1) a burn rate or (2) a total burn. (Note that, as used in this disclosure, burn refers to measureable wear of a dental device, such as the splay displacement of a brush head in a toothbrush). For example, if sensor 106 is a force sensor and measures the force applied to a brush (or other type of dental cleaning head), the burn rate may be calculated from the known characteristics of a brush as it responds to force. This may be performed via a predetermined calculation or through a look-up table. It will be appreciated that the different brush heads will burn at different rates: a soft brush head may burn at a quick rate, while a hard brush head may be burn at a slow rate. Other types of sensors may be similarly used to determine burn rate. For example, an accelerometer may measure be similarly used to measure the motion and/or force applied to the dental cleaning head. A Hall Effect sensor may be used to measure the force applied to the dental cleaning head via the characteristics of the electric motor as they vary with loading on the head. Accordingly, from sensor 106 the burn rate of a dental cleaning head 104 may be determined. It will be appreciated that other sensors besides the sensors described here, or a combination of sensors, may be used to determine the burn rate of a dental cleaning head.

As mentioned, sensor 106 may also be used to measure total burn of a dental cleaning head. For example, in a toothbrush embodiment, an optical sensor may be placed to measure the width of a brush head, which correlates to the splaying, i.e. total burn, of the brush head. The optical sensor may be a part of dental cleaning device 102 or it may be the optical sensor of mobile device, such as a smart phone, or on another device, such as the charging station of dental cleaning device 102 or smart bathroom mirror. The optical sensor of the mobile device may be accessed via a dedicated application installed on the mobile device. The width of the brush head may be compared to a predetermined model of the brush head, to determine to the difference and thus determine the total splaying. Alternatively, one of the sensors that may be used to measure the burn rate, such as an accelerometer, a Hall Effect sensor, or another sensor, may alternately be used to measure total burn. As the bristles of dental cleaning head 104 in a toothbrush embodiment, begin to splay, the deformed bristle shape will impact the dynamics of the toothbrush (in other embodiments, the features of other kinds of dental cleaning devices that begin to wear may similarly impact the dynamics of the dental cleaning device). The stiffness of bristles in combination with the internal dynamics of dental cleaning device 102 (stiffness, damping and mass) define the mode shapes and natural frequencies of dental cleaning device 102. Thus, a change in mode shape or natural frequency compared to the original configuration can be used as a detection mechanism for brush head displacement (i.e. total burn). These changes may be measured by a sensor such as an accelerometer or Hall Effect sensor. However, instead of an accelerometer or Hall Effect sensor, a cheaper alternative may be to measure the impedance or frequency of the motor under load. In general, any sensor which depends on the dynamic behavior of the system may be used (e.g. a microphone).

The transmissibility from motor voltage/current to acceleration level at a given location within dental cleaning device 102, in a toothbrush example, depends on the stiffness of the bristles. For specific mode shapes, the contribution of the bristle stiffness is larger than for other modes. As a result, a specific frequency range of voltage/current is more sensitive for brush damage than others. Thus, for example, the input voltage/current frequency to the motor may be swept and the acceleration or voltage difference across a conductor may be measured to determine the dynamic behavior of dental cleaning device 102. The dynamic behavior of dental cleaning device 102 may correlate to a total burn of dental cleaning head 104. Note that for constant excitation it is sufficient to check only the output of the accelerometer instead of the transmissibility.

In the embodiment where dental cleaning device 102 is a tongue brush, the brush "spikes" may begin to exhibit wear, which may be measured by an optical sensor, or through an accelerometer, force sensor, or similar sensor which can measure the motion or force applied to the tongue brush. In the embodiment where dental cleaning device 102 is an AirFloss, a picture, taken with an optical sensor (located on cleaning device 102, a mobile device or a fixed device), may be used to detect the shape of the water jet, or the shape of the stream of water exiting the water jet, as the head of the AirFloss begins to show signs of wear. Alternately, an accelerometer may be positioned to measure the vibration of the AirFloss handle, which may change as the AirFloss head begins to show wear or disfigurement through use. One of ordinary skill will recognize that there are any number of ways to measure the burn rate or total burn of any type of dental cleaning head, and each method cannot be illustrated here.

Figure 3:
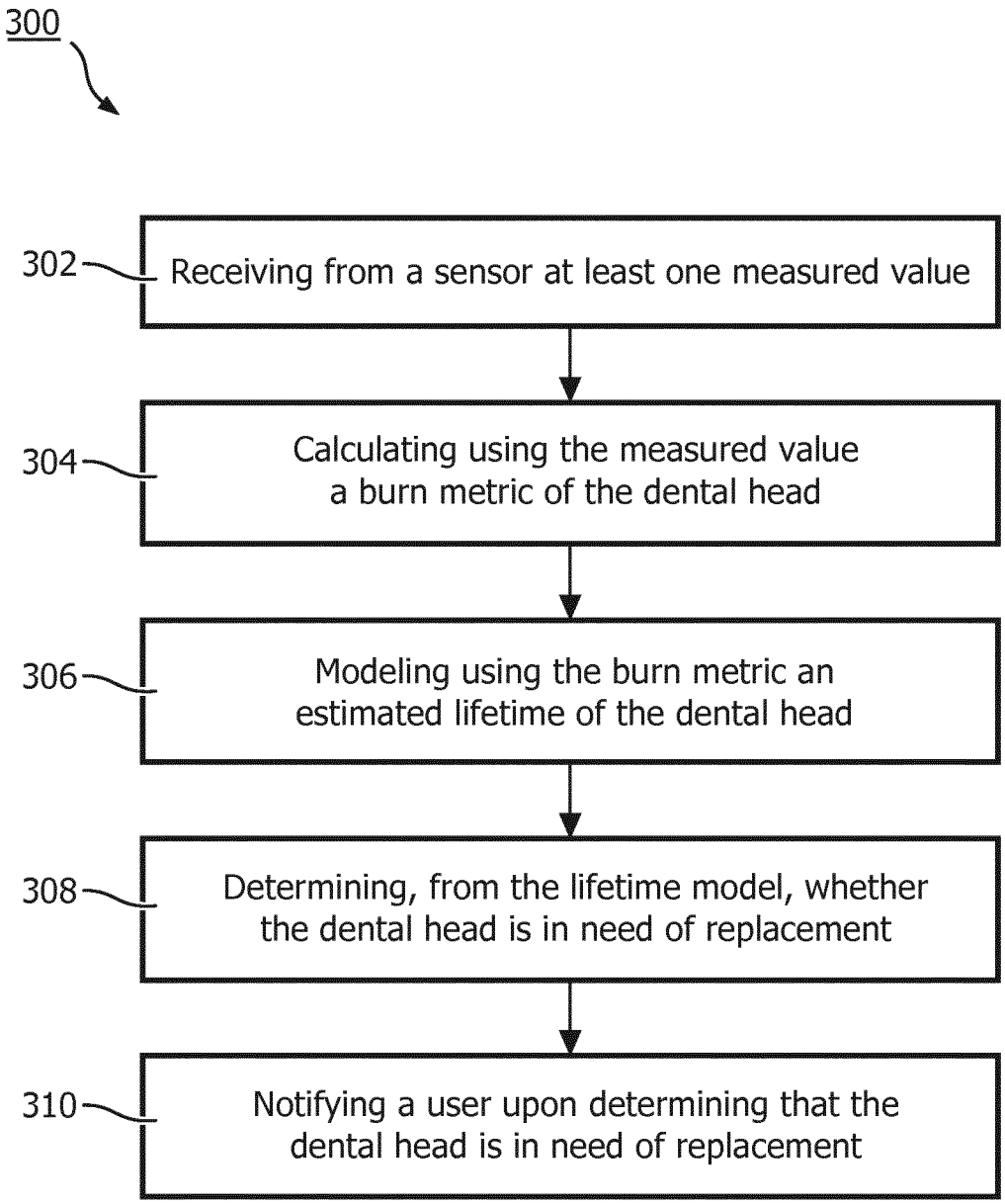
FIG. 3 is a flowchart of a method for predicting the lifetime of a dental cleaning head, according to an embodiment.

Referring to FIG. 3, there is shown a flow chart of a method 300 for modeling the lifetime of dental cleaning head. The method utilizes one or more embodiments of the systems described or otherwise envisioned herein. For example, method 300 may use system 100 described above, including dental cleaning device 102 and a remote server. Alternately, the method may be wholly performed by dental cleaning device 102.

In step 302, at least one measured value is received from sensor 106. The measurement may represent a force applied to dental cleaning head 104, or a user-applied load, or it may be a measured width of the bristles of dental cleaning head 104, or a vibration, or a measured natural frequency or mode shape of dental cleaning device 102, or other methods of measuring burn as have been described herein and as will be apparent to a person of ordinary skill, according to the sensor 106 employed and the method of using sensor 106.

In step 304, a burn metric, such as a burn rate per cleaning session (or per another unit time) of the dental cleaning head 104 or a total burn of the dental cleaning head 104 is calculated using the measured value of step 302. If the measured value was a force applied to dental cleaning head 104, this step may include time integrating the continuous force measured. Or, for more rudimentary force sensors, such as sensors that only register that a force has exceeded a predefined limit, the amount of time logged that the force exceeded that limit may be time integrated.

Figure 4:
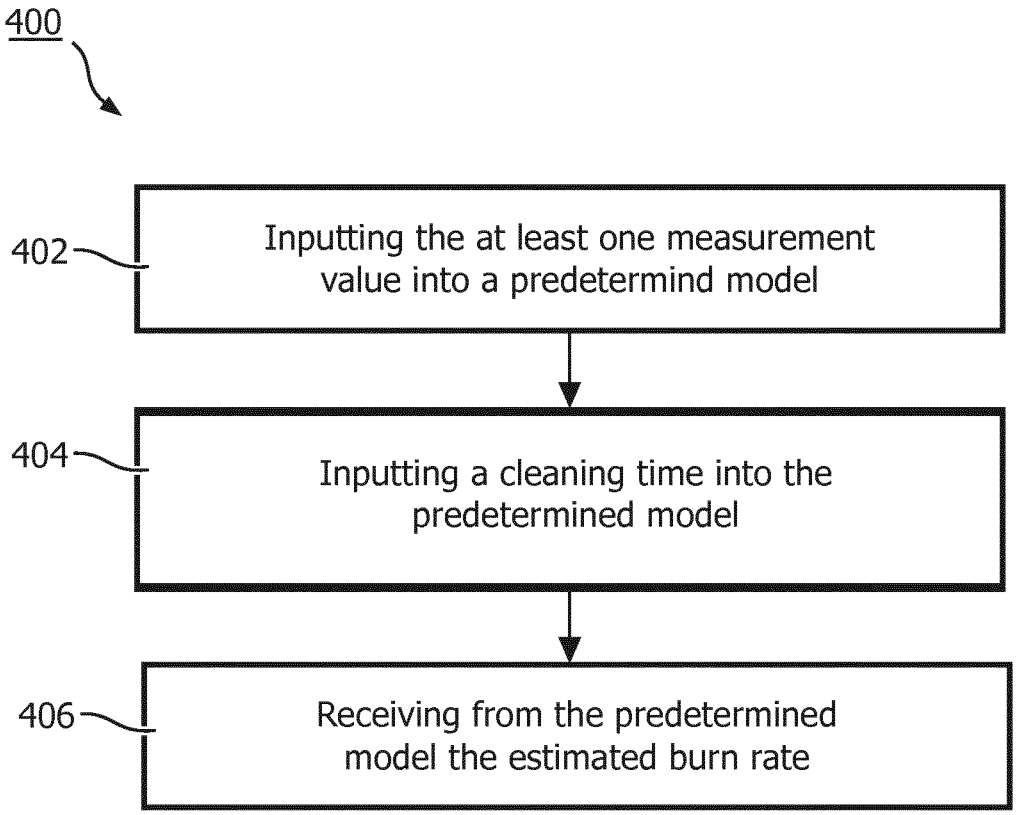
FIG. 4 is a flowchart of a method for calculating a burn metric of a dental cleaning head, according to an embodiment.

Further, a model of the characteristics of the dental cleaning head, such as the length of the bristles, stiffness of the bristles (in a toothbrush embodiment), etc., may be employed to more accurately determine the burn rate of the particular dental cleaning head 104 used. As shown in FIG. 4, at step 402, the measured value of step 302 is input into the model to more accurately estimate the burn rate of the dental cleaning head for a session (or other unit of time).

At step 404, the cleaning time may be input into the predetermined model. The cleaning time may be the total time of a cleaning session (i.e. the time that the dental cleaning device is switched on), or it may be the time that a measured value indicating use is detected with respect to dental cleaning device 102. For example, the cleaning time may be the time that a force applied to dental cleaning head 104 exceeds a predetermined value. Alternately, the cleaning time may be measured according to the time that a proximity sensor, or other sensor, detects that dental cleaning device 102 is near to or touching the teeth of a user. In an embodiment, such as a Philips AirFloss, where the cleaning action is delivered in short bursts, the cleaning time may be a function of the number of cleaning shots delivered. One of ordinary skill will appreciate that cleaning time may be measured in any number of ways, each of which may not be fully illustrated here.

And at step 406, the burn rate may be received from the model. The model may be based on design elements as well as use conditions. For example, the model may be based on the types of loading and motion that may be measured by sensor 106. Alternately, or additionally, the model may be based on measured behaviors of the dental cleaning head/handle combination as some handles wear out dental cleaning heads slightly faster. Alternately the model may be based on theoretical models that predict the wear based on the ensemble of bristles and tufts. For example, a polynomial that models the characteristics of the bristles of toothbrush head (including terms such as the square, cube of instantaneous force, etc.) may be time integrated using the measured force data, to return the estimated burn rate. In an alternate embodiment, for each dental cleaning head, a predetermined curve or look up table may be employed to determine to model the burn rate for a given force and for a given time. In an alternate embodiment, the model may be an equation, lookup table, or curve that returns burn per shot delivered by a dental cleaning device 102, such as a Philips AirFloss. Please note, that the current total burn may itself be an input into the model, as the burn rate may change as the bristles begin to splay or other features show signs of wear in other types of dental cleaning heads.

Note that the predetermined model may be selected from a plurality of predetermined models, according to the kind of brush head used. For example, a given brush head may have unique identifier, which would communicate to the local or backend system 108 the qualities of the brush head, such as stiffness, that would be used in the predetermined model. Alternatively, local or backend system may be programmed to identify the brush head being used and to retrieve from a database or a look up table the corresponding model. It will be appreciated that there may be other ways for the local or backend system 108 to apply the appropriate predetermined model.

Alternatively, if the measured value is a width of the bristles of dental cleaning head 104, or a characteristic of dental cleaning device 102, such as natural frequency or mode shape, or other similar measurement, the total burn of dental cleaning head 104 may be calculated. For example, the total burn of the brush head may be determined using an optical sensor, located on dental cleaning device 102 or on a different device, by comparing its actual width (or length) with a predefined one. Alternatively, if a different sensor, such as a Hall Effect sensor, or accelerometer, or microphone, is used detect a change in mode shape or natural frequency, the measured value, (i.e. impedance, sound, accelerometer output, etc.) must be correlated with the total burn of the dental cleaning head. This may be accomplished through models such as an equation or a lookup table.

In an embodiment, once the total burn is measured, the measurement may be used to improve the burn rate model, in order to enhance the accuracy of prediction for the particular user. Thus for example, the daily burn rate may be estimated at step 304, and when the total burn is estimated to be over a threshold, the user can be prompted to perform a total burn measurement, e.g., by imaging the dental cleaning head by phone camera or by another sensor. Thus, if the total burn had been predicted to be at a certain point, but checking the splaying of the brush reveals that the total burn is actually greater than predicted, the burn rate model may be modified to account for the faster burn rate for that user. Furthermore, if sensors such as an accelerometer or Hall Effect sensor are being used to predict the total burn of the dental cleaning head, the accuracy of this prediction may too be improved by checking the actual total burn with a different sensor such as a smart phone camera. The occasional measurement not only enhances accuracy of the burn estimation, but also can motivate the user to change heads by comparing the image of the current dental cleaning head with a new one—making the contrast immediately visible to the user.

Figure 5:
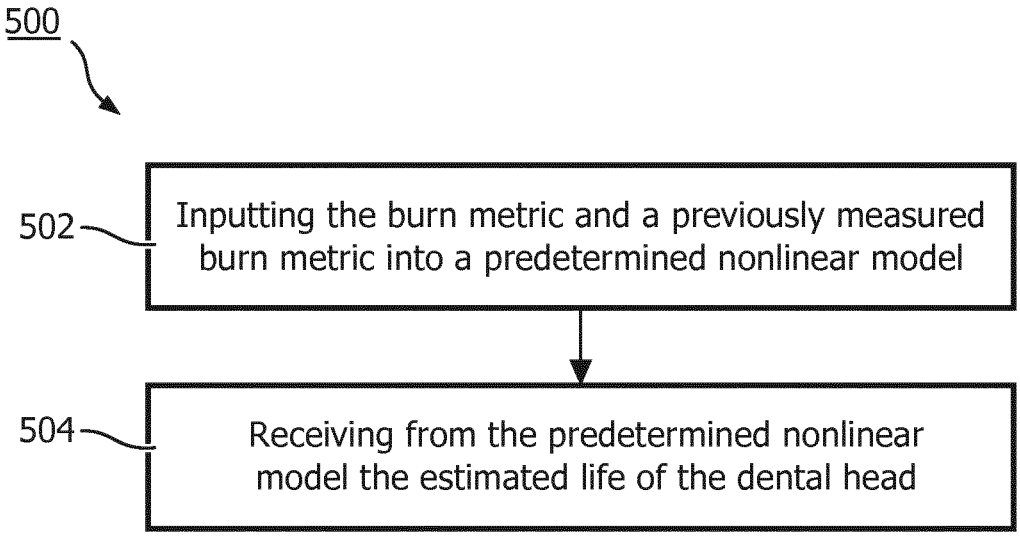
FIG. 5 is a flowchart of a method for modeling a lifetime of a dental cleaning head, according to an embodiment.

Once a burn metric has been calculated, in step 306, the lifetime of dental cleaning head 104 may be modeled, using the calculated burn metric as shown in FIG. 5. At step 502 the measured burn metric, and a previously measured burn metric (from an earlier cleaning) is input into a predetermined nonlinear model. The model, such as a linear, weighted linear, or nonlinear regression, or any other model sufficient for extrapolating from a known data set, may be used. (Note that if only one measurement has been taken, a single burn metric may be used with a linear model). At step 504, the model returns the estimated life of the dental cleaning head. Each time a burn metric is received or otherwise calculated, a new model may be generated, which will be stored, replacing the previously generated model. For example, from a cleaning session, a burn rate estimation of 0.6% may be generated. Using a linear model in this case may lead to 166 cleaning sessions (1/0.6%). This may be similarly calculated for total burn. Each new received cleaning session may add an additional data point and the model may be recalculated, replacing the earlier calculated model.

If the average number of cleaning sessions per day is known for a user, the number of days remaining may be calculated. For example, if it is known that a user brushes an average of twice a day, and the model is predicting a remaining 166 cleaning sessions, it may be calculated that 83 days remain of the lifetime of the dental cleaning head. The user's cleaning habits may be manually input to a local or back end system 108 or may be determined from use of dental cleaning device 102. Alternatively, a number of cleaning sessions may be assumed from the use of an average user. Once the lifetime model is generated, the information may be stored in a local system, such as the user's smartphone calendar, or to a back-end system such as a remote server.

Note that several sensors may be used or a single sensor may be used in several ways. Indeed, both burn rate and total burn may be measured by multiple sensors or by a single sensor. For example, one sensor may be used to estimate burn rate, while a different sensor or the same sensor may be used to measure total burn. These results may be averaged, both input into a model, or may be used to check the outputs of independent models, so as to ensure accurate modeling of the life of the brush.

In step 308, it is determined whether dental cleaning head 104 is in need of replacement. This step may include comparing the current total burn of dental cleaning head 104 with a predetermined limit. For example, predetermined limit may be automatically set to a certain limit, such as 95% of the total burn of a head, or it may be set to a value by a user. Even if this total burn is not measured through use, such as if sensor 106 ceases measuring, or if dental cleaning device 102 ceases communicating with local or back end, this limit may be automatically updated according to the lifetime model and the passage of days. For example, if the model predicted that the user had 14 days of life remaining for the current dental cleaning head 104, and if connectivity is lost, the model may continue updating automatically, even without receiving data from dental cleaning device 102.

In step 310, once the predetermined limit is reached in step 308, the user may be notified via push notification or through some other method. For example, a mobile application on the user's phone, such as a calendar, or a dedicated application may send a push notification to the user that it is time to change the dental cleaning head 104. Alternatively, display screen 114 located on dental cleaning device 102 itself may notify user that it is time to change the dental cleaning head.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A method of determining and notifying a user when to replace a dental cleaning head, comprising:

receiving, from a sensor, at least one measured value;

calculating, using the at least one measured value, a burn metric of the dental cleaning head, wherein the burn metric corresponds to measurable wear of the dental cleaning head and the burn metric is based at least in part on a characteristic of the dental cleaning head;

modeling, using the burn metric, an estimated lifetime of the dental cleaning head;

determining, from the lifetime model, whether the dental cleaning head is in need of replacement; and notifying the user upon determining that the dental cleaning head is in need of replacement;

wherein the step of modeling the estimated life of the dental cleaning head further comprises the steps of:

inputting the burn metric and a previously measured burn metric into a predetermined nonlinear model; and receiving from the predetermined nonlinear model the estimated life of the dental cleaning head.

2. The method of claim 1, wherein the burn metric is a burn rate of the dental cleaning head.

3. The method of claim 1, wherein the burn metric is a total burn of the dental cleaning head.

4. The method of claim 2, wherein the step of calculating the burn rate comprises:

inputting the at least one measured value into a predetermined model;

inputting a cleaning time into the predetermined model; and receiving from the predetermined model the estimated burn rate.

5. The method of claim 4, wherein the predetermined model is selected from a plurality of predetermined models, according to a value of the dental cleaning head.

6. The method of claim 1, wherein the at least one measured value is one of: a force, a user-applied load, or a characteristic of a drive train of a dental cleaning device.

7. The method of claim 1, wherein the user is notified by a mobile application.

8. The method of claim 1, wherein the lifetime model is stored on a remote server.

9. A system for notifying a user when to replace a worn dental cleaning head, comprising:

an application comprising program code stored on a non-transitory storage medium and programmed to:

receive, from a sensor, data representing at least one measured value;

estimate, from the received data, a burn metric of the dental cleaning head, wherein the burn metric corresponds to measurable wear of the dental cleaning head, wherein the measurable wear comprises splay displacement, and the burn metric is based at least in part on a characteristic of the dental cleaning head;

model, using the estimated burn metric, an estimated life of the dental cleaning head;

determine, from the lifetime model, whether the dental cleaning head is in need of replacement; and notify the user upon determining that the dental cleaning head is in need of replacement.

10. The system of claim 9, further comprising:

a dental cleaning device, having at least one sensor configured to measure at least one measured value metric corresponding to a force applied to a dental cleaning head wherein the dental cleaning device is configured to transmit, to the application, the at least one measured value.

11. The system of claim 10, wherein the application is stored and executed on the dental cleaning device.

12. The system of claim 9, wherein the application is distributed over at least a mobile device and a remote server.

13. The system of claim 9, wherein the application is configured to notify the user via a push notification on a mobile device.

14. The system of claim 9, wherein the at least one measured value is one of: a force, a user-applied load, or a characteristic of a drive train of a dental cleaning device.

15. A method of determining and notifying a user when to replace a dental cleaning head, comprising:

receiving, from a sensor, at least one measured value;

calculating, using the at least one measured value, a burn metric of the dental cleaning head, wherein the burn metric corresponds to measurable wear of the dental cleaning head and the burn metric is based at least in part on a characteristic of the dental cleaning head;

modeling, using the burn metric, an estimated lifetime of the dental cleaning head;

determining, from the lifetime model, whether the dental cleaning head is in need of replacement; and notifying the user upon determining that the dental cleaning head is in need of replacement;

wherein the measurable wear comprises splay displacement.

16. The method of claim 15, wherein the burn metric is a burn rate of the dental cleaning head.

17. The method of claim 15, wherein the burn metric is a total burn of the dental cleaning head.

18. The method of claim 16, wherein the step of calculating the burn rate comprises:

inputting the at least one measured value into a predetermined model;

inputting a cleaning time into the predetermined model; and receiving from the predetermined model the estimated burn rate.

19. The method of claim 18, wherein the predetermined model is selected from a plurality of predetermined models, according to a value of the dental cleaning head.

20. The method of claim 15, wherein the step of modeling the estimated life of the dental cleaning head further comprises the steps of:

inputting the burn metric and a previously measured burn metric into a predetermined nonlinear model; and receiving from the predetermined nonlinear model the estimated life of the dental cleaning head.

21. The method of claim 15, wherein the at least one measured value is one of: a force, a user-applied load, or a characteristic of a drive train of a dental cleaning device.

22. The method of claim 15, wherein the user is notified by a mobile application.

23. The method of claim 15, wherein the lifetime model is stored on a remote server.

* * * * *